US010951011B2

(12) United States Patent
Tanaka et al.

(10) Patent No.: US 10,951,011 B2
(45) Date of Patent: Mar. 16, 2021

(54) SPARK PLUG FOR INTERNAL COMBUSTION ENGINES

(71) Applicant: DENSO CORPORATION, Kariya (JP)

(72) Inventors: Daisuke Tanaka, Nisshin (JP); Fumiaki Aoki, Nisshin (JP); Naoto Hayashi, Kariya (JP); Daisuke Shimamoto, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 16/912,751

(22) Filed: Jun. 26, 2020

(65) Prior Publication Data

US 2020/0335950 A1 Oct. 22, 2020

Related U.S. Application Data

(63) Continuation of application No. PCT/JP2018/047406, filed on Dec. 24, 2018.

(30) Foreign Application Priority Data

Dec. 28, 2017 (JP) ..... JP2017-253620

(51) Int. Cl.
*H01T 13/32* (2006.01)

(52) U.S. Cl.
CPC ..... *H01T 13/32* (2013.01)

(58) Field of Classification Search
CPC ..... H01T 13/32; H01T 13/20
See application file for complete search history.

(56) References Cited

U.S. PATENT DOCUMENTS

2008/0092839 A1* 4/2008 Hanashi ..... H01T 13/18 123/169 R
2014/0210336 A1* 7/2014 Yamada ..... H01T 13/36 313/143

FOREIGN PATENT DOCUMENTS

| | | |
|---|---|---|
| JP | 9-129356 | 5/1997 |
| JP | 2010-238377 | 10/2010 |
| WO | 2016/013615 | 1/2016 |

* cited by examiner

*Primary Examiner* — Donald L Raleigh
(74) *Attorney, Agent, or Firm* — Nixon & Vanderhye P.C.

(57) ABSTRACT

A spark plug includes a housing, an insulator, a center electrode, and an earth electrode. The earth electrode has a gap-forming surface which forms a discharge gap between the gap-forming surface and a tip surface of the center electrode. The insulator includes an insulator protrusion protruding on the tip side of the housing in a plug axial direction. At least one of cross-sections passing through a plug center axis and parallel to the plug axial direction is referred to as an axial parallel cross-section. The outer peripheral surface of the insulator protrusion includes an insulator inclined surface extending inward toward the tip in the plug axial direction, in a straight line or a curve that is convex inward, in the axial parallel cross-section. In the axial parallel cross-section, a virtual straight line passing through both ends of the insulator inclined surface passes through the gap-forming surface.

4 Claims, 18 Drawing Sheets

SPARK PLUG FOR INTERNAL COMBUSTION ENGINES

CROSS-REFERENCE TO RELATED APPLICATION

The present application is a continuation application of International Application No. PCT/JP2018/047406 filed on Dec. 24, 2018, which is based on and claims the benefit of priority from Japanese Patent Application No. 2017-253620 filed Dec. 28, 2017. The contents of these applications are incorporated herein by reference in their entirety.

BACKGROUND

The present disclosure relates to spark plugs for internal combustion engines.

A spark plug is used as an ignition means in an internal combustion engine such as an automobile engine. In some spark plugs, a center electrode and an earth electrode are opposed to each other to form a discharge gap. In the case of such spark plugs, an electric discharge is induced in the discharge gap, and an air-fuel mixture in a combustion chamber is ignited by this electric discharge.

SUMMARY

One aspect of the present disclosure is a spark plug for internal combustion engines that includes:

a housing;

an insulator;

a center electrode; and an earth electrode, wherein the insulator includes an insulator protrusion protruding on a tip side of the housing, an outer peripheral surface of the insulator protrusion includes an insulator inclined surface extending inward toward a tip in a plug axial direction in an axial parallel cross-section, and in the axial parallel cross-section, a virtual straight line passing through both ends of the insulator inclined surface passes through a gap-forming surface.

BRIEF DESCRIPTION OF THE DRAWINGS

These and other objects, features and advantages of the present disclosure will become more apparent from the following detailed description taken in conjunction with the accompanying drawings, in which.

DETAILED DESCRIPTION OF THE PREFERRED EMBODIMENTS

Figure 1:
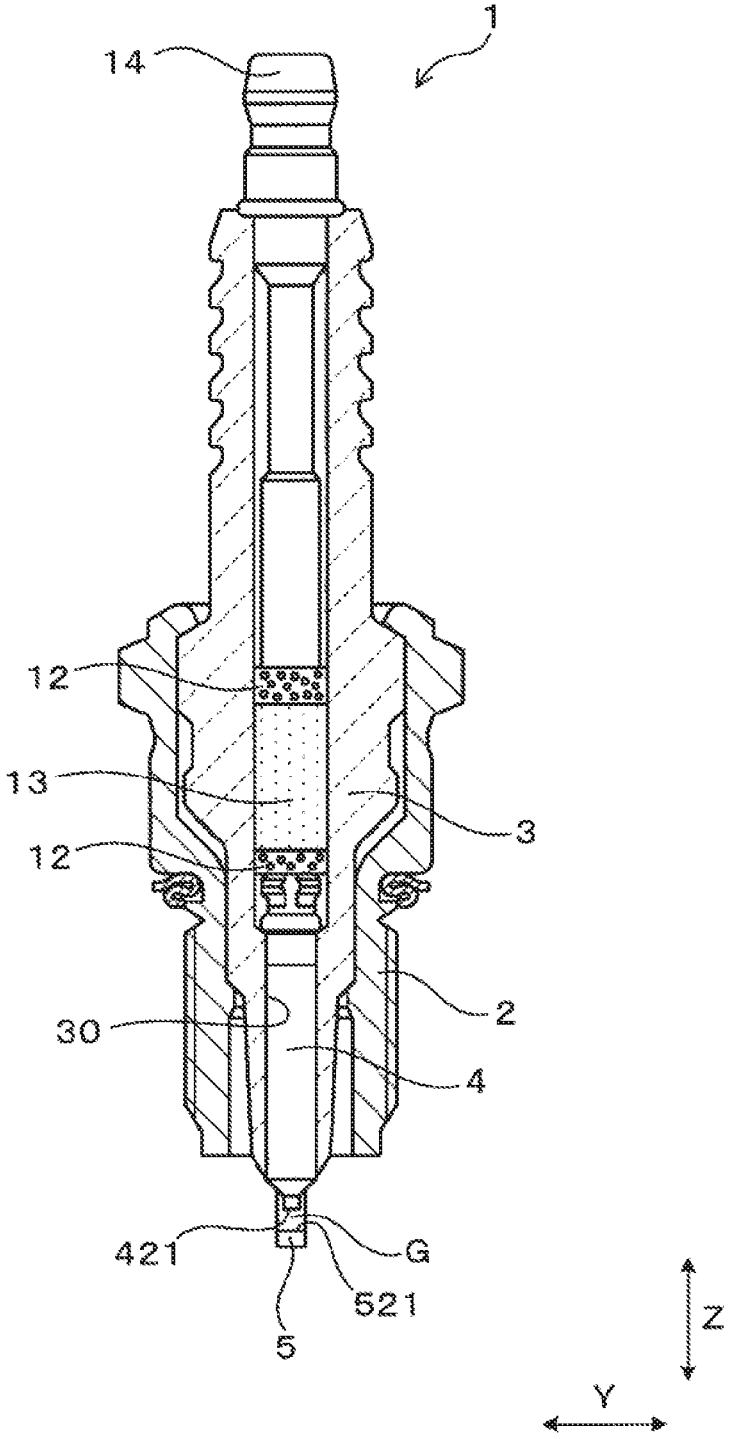
FIG. 1 is a cross-sectional view of a spark plug according to Embodiment 1.

A spark plug is used as an ignition means in an internal combustion engine such as an automobile engine. In some spark plugs, a center electrode and an earth electrode are opposed to each other to form a discharge gap. In the case of such spark plugs, an electric discharge is induced in the discharge gap, and an air-fuel mixture in a combustion chamber is ignited by this electric discharge.

In the combustion chamber, an airflow of the air-fuel mixture, represented by a tumble flow, for example, is formed, and as a result of this airflow moderately moving in the discharge gap, an electric spark can be stretched by the airflow. Stretching the electric spark results in an increase in the contact area between the electric spark and the air-fuel mixture in the combustion chamber, ensuring the ignitability of the air-fuel mixture.

In the spark plug disclosed in JP 2010-238377 A, in order to easily guide the airflow to the discharge gap, the outer peripheral surface of a tip portion of a housing exposed to the inside of the combustion chamber is an inclined surface that is inclined to reduce the diameter of the tip portion toward a tip in a plug axial direction. Thus, the airflow in the combustion chamber is guided on the inclined surface of the housing and is likely to move toward the discharge gap.

The spark plug disclosed in JP 2010-238377 A is configured so that a tip portion of an insulator is not exposed on the tip side of the housing. Thus, electrically conductive carbon resulting from incomplete combustion in the combustion chamber easily enters into the space between the tip portion of the insulator and the housing. Accordingly, the likelihood of the carbon being accumulated on a surface of the tip portion of the insulator is high. This causes the problem of so-called lateral sparks in which an electric discharge occurs between the center electrode and the housing via the carbon accumulated on the surface of the tip portion of the insulator.

In addition, the spark plug disclosed in PTL 1 has room for improvement from the perspective of increasing the ignitability of the air-fuel mixture in the combustion chamber.

The present disclosure provides a spark plug for internal combustion engines that easily increases the ignitability of an air-fuel mixture in a combustion chamber with less likelihood of lateral sparks.

One aspect of the present disclosure is a spark plug for internal combustion engines that includes:

a housing having a cylindrical shape;

an insulator held inside the housing and having a cylindrical shape;

a center electrode held inside the insulator; and an earth electrode having a gap-forming surface which forms a discharge gap between the gap-forming surface and a tip surface of the center electrode, wherein the insulator includes an insulator protrusion protruding on a tip side of the housing, an outer peripheral surface of the insulator protrusion includes an insulator inclined surface extending inward toward a tip in a plug axial direction, in a straight line or a curve that is convex inward, in an axial parallel cross-section that is at least one of cross-sections passing through a plug center axis and parallel to the plug axial direction, and in the axial parallel cross-section, a virtual straight line passing through both ends of the insulator inclined surface passes through the gap-forming surface.

In the spark plug for internal combustion engines, the insulator protrusion of the insulator protrudes on the tip side of the housing. Thus, carbon is less likely to accumulate on a surface of the insulator protrusion of the insulator. Accordingly, the occurrence of lateral sparks can be reduced.

Furthermore, the outer peripheral surface of the insulator protrusion includes an insulator inclined surface extending inward toward the tip in the plug axial direction, in a straight line or a curve that is convex inward, in the axial parallel cross-section. Moreover, in the axial parallel cross-section, a virtual straight line passing through the both ends of the insulator inclined surface passes through the gap-forming surface of the earth electrode. Thus, the airflow in the combustion chamber is guided to move along the insulator inclined surface and run through the discharge gap. This allows the airflow to move moderately through the discharge gap. Therefore, the electric spark can be easily stretched, and the ignitability of the air-fuel mixture in the combustion chamber can be easily increased.

Furthermore, the airflow in the combustion chamber is guided by the insulator inclined surface so as to flow in the discharge gap diagonally toward the tip. Therefore, the electric spark is stretched by the airflow diagonally toward the tip, in other words, toward the center of the combustion chamber. To put it differently, the electric spark is stretched away from an engine head. Thus, the heat of a flame caused by the electric spark igniting the air-fuel mixture can be easily prevented from being drawn by the engine head, meaning that the flame is likely to grow.

Furthermore, in the spark plug for internal combustion engines, the insulator inclined surface of the insulator that is located closer to the discharge gap than the housing is guides the direction of travel of the airflow. Therefore, the airflow can enter the discharge gap at an angle close to the plug axial direction. Thus, the electric spark can be more easily stretched toward the tip, and the ignitability can be more easily increased.

As described above, according to the aforementioned aspect, it is possible to provide a spark plug for internal combustion engines that easily increases the ignitability of an air-fuel mixture in a combustion chamber with less likelihood of lateral sparks.

Embodiment 1

An embodiment of a spark plug for internal combustion engines is described with reference to FIGS. 1 to 6.

Figure 2:
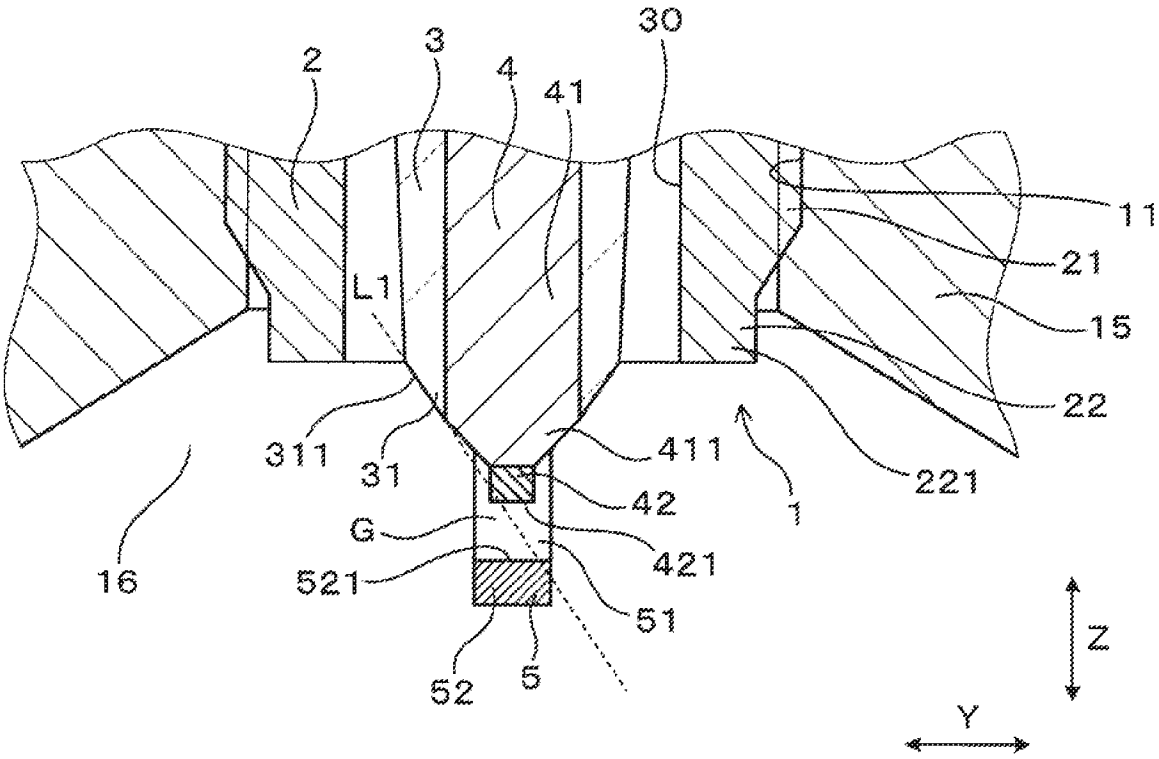
FIG. 2 is a cross-sectional view of an area around a tip portion of a spark plug according to Embodiment 1 attached to an internal combustion engine.
Figure 3:
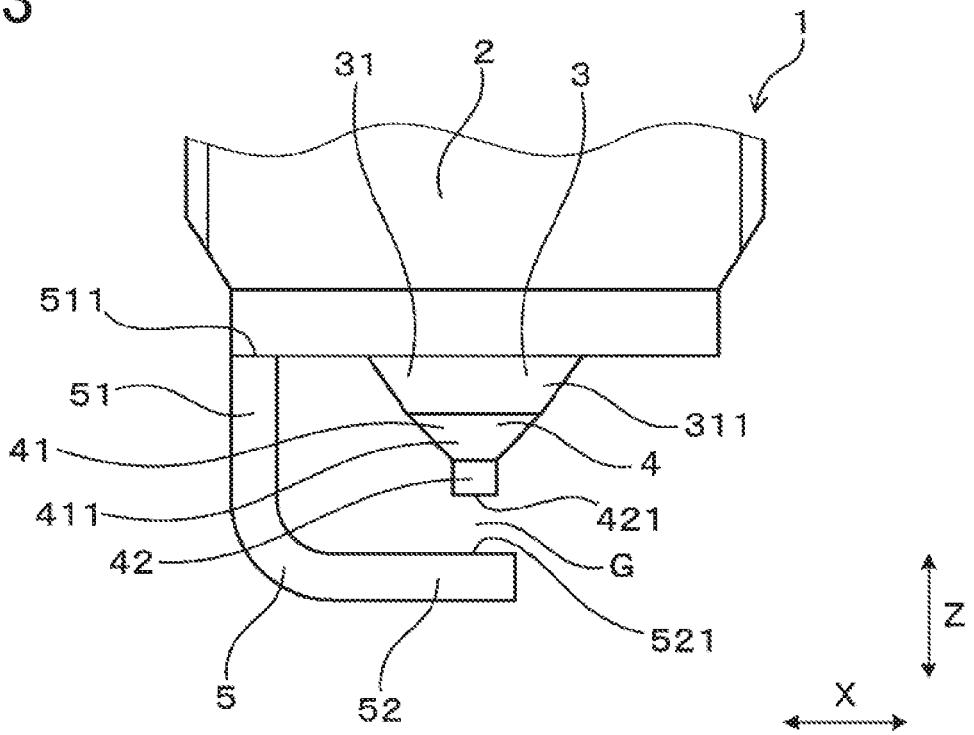
FIG. 3 is a side view of the area around the tip portion of the spark plug according to Embodiment 1.

As shown in FIG. 1, a spark plug for internal combustion engines according to the present embodiment includes a housing 2, an insulator 3, a center electrode 4, and an earth electrode 5. The housing 2 has a cylindrical shape. The insulator 3 is held inside the housing 2. The insulator 3 has a cylindrical shape. The center electrode 4 is held inside the insulator 3. As shown in FIGS. 1 to 3, the earth electrode 5 has a gap-forming surface 521 which forms a discharge gap G between the gap-forming surface 521 and a tip surface 421 of the center electrode 4.

As shown in FIGS. 2 and 3, the insulator 3 includes an insulator protrusion 31 protruding on the tip side of the housing 2. At least one of cross-sections passing through a plug center axis and parallel to a plug axial direction Z is referred to as an axial parallel cross-section. As shown in FIG. 2, the outer peripheral surface of insulator protrusion 31 includes an insulator inclined surface 311 extending inward toward the tip in the plug axial direction Z, in a straight line or a curve that is convex inward, in the axial parallel cross-section. In the axial parallel cross-section, a virtual straight line L1 passing through both ends of the insulator inclined surface 311 passes through the gap-forming surface 521. Note that FIG. 2 is one example of the axial parallel cross-section. Hereinafter, the present embodiment is described in detail.

Note that in the present description, the plug center axis means the center axis of the spark plug 1. The plug axial direction Z means the axial direction of the spark plug 1. A plug radial direction means the radial direction of the spark plug 1. The simple wording "inward" means inward in the plug radial direction, and the simple wording "outward" means outward in the plug radial direction.

The spark plug 1 can be used, for example, as an ignition means for an internal combustion engine of an automobile, cogeneration, or the like. One end of the spark plug 1 in the plug axial direction Z is connected to an ignition coil now shown in the drawings, and the other end of the spark plug 1 in the plug axial direction Z is disposed in a combustion chamber 16 of the internal combustion engine, as shown in FIG. 2. In the present description, when viewed in the plug axial direction Z, the end connected to the ignition coil is referred to as a base, and the end disposed in the combustion chamber 16 is referred to as a tip.

As shown in FIG. 2, the housing 2 includes, at a tip portion thereof, an attachment screw portion 21 to be used for attachment in a female threaded hole 11 provided in an engine head 15. Furthermore, the housing 2 includes an annular housing tip portion 22 which protrudes further on the tip side than the attachment screw portion 21 does. The tip of the housing tip portion 22 forms a housing exposed portion 221 which is exposed to the inside of the combustion chamber 16. A tip surface of the housing exposed portion 221 is orthogonal to the plug axial direction Z.

The insulator 3 is formed from alumina in a substantially cylindrical shape, for example. As shown in FIG. 1, the insulator 3 has a shaft hole 30 formed therethrough in the plug axial direction Z. A tip portion (that is, the insulator protrusion 31) of the insulator 3 protrudes on the tip side of the housing 2 in plug axial direction Z. Furthermore, a base portion of the insulator 3 protrudes at the base of the housing 2.

Figure 4:
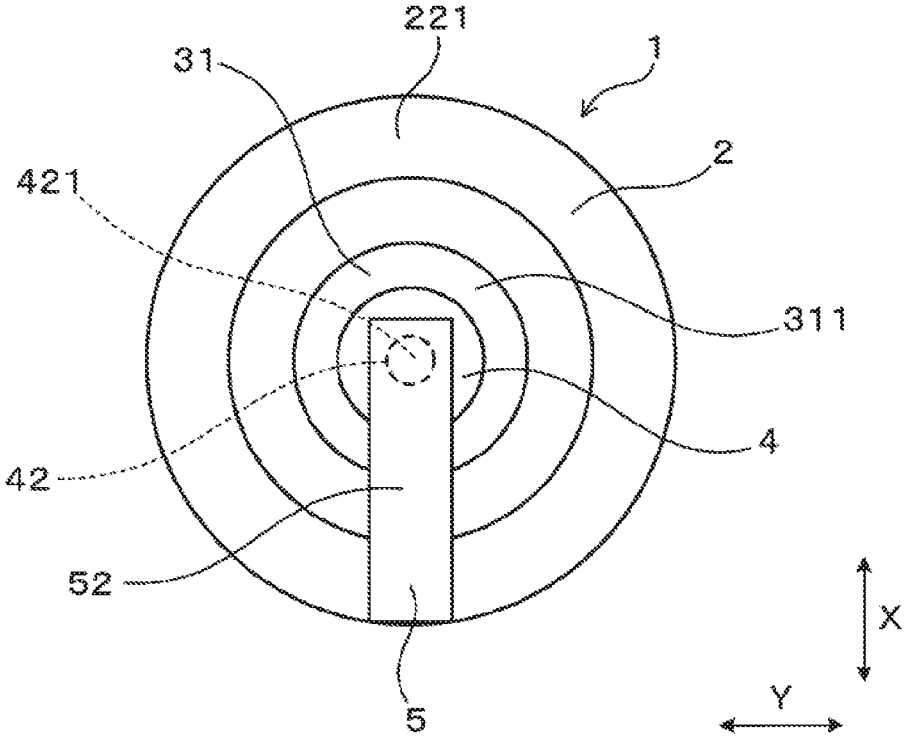
FIG. 4 is a plan view of a portion of the spark plug according to Embodiment 1 that is exposed in the internal combustion engine when viewed from the tip side.

As shown in FIG. 2, the outer peripheral surface of the insulator protrusion 31 includes an insulator inclined surface 311 formed in a straight line to extend inward toward the tip in the axial parallel cross-section. The outer peripheral surface of the insulator protrusion 31 includes an insulator inclined surface 311 in an axial parallel cross-section parallel to at least both the plug axial direction Z and a lateral direction Y. As shown in FIG. 4, in the present embodiment, the outer peripheral surface of the insulator protrusion 31 includes, along the entire perimeter thereof, the insulator inclined surface 311. In other words, the outer peripheral surface of the insulator protrusion 31 includes the insulator inclined surface 311 in every cross-section passing through the plug center axis and parallel to the plug axial direction Z. In the present embodiment, the entire exposed surface of the insulator protrusion 31 is the insulator inclined surface 311.

As shown in FIG. 2, the size of the insulator inclined surface 311 is formed to be larger in the plug axial direction Z than in the plug radial direction in the axial parallel cross-section. In the present embodiment, the insulator inclined surface 311 is formed to connect to the shaft hole 30 of the insulator 3.

The center electrode 4 is inserted into and held at a tip portion of the shaft hole 30 of the insulator 3. The center electrode 4 is positioned to substantially align the center axis thereof with the plug center axis.

As shown in FIGS. 2 and 3, the center electrode 4 includes a center electrode base material 41 and a center electrode chip 42. A tip portion of the center electrode base material 41 forms a center electrode protrusion 411 which protrudes further on the tip side than the insulator protrusion 31 does. The center electrode protrusion 411 has a truncated cone shape that tapers toward the tip. The center electrode chip 42 is joined to a tip surface of the center electrode protrusion 411.

As shown in FIGS. 2 and 3, the center electrode chip 42 is in the shape of a column having substantially the same diameter as the tip surface of the center electrode protrusion 411. The center axis of the center electrode chip 42 is aligned with the center axis of the spark plug 1. The tip surface 421 of the center electrode chip 42 faces the gap-forming surface 521 of the earth electrode 5 in the plug axial direction Z to form the discharge gap G.

As shown in FIG. 3, the earth electrode 5 includes an upright portion 51 and an inwardly-extending portion 52. The upright portion 51 includes, at an end portion on the base side, an earth-connecting portion 511 connected to the tip surface of the housing 2. In the present embodiment, the earth-connecting portion 511 is orthogonal to the plug axial direction Z. The upright portion 51 is provided upright on the tip side from the tip surface of the housing 2 along the plug axial direction Z.

The inwardly-extending portion 52 extends from an end portion of the upright portion 51 on the tip side inward in the plug radial direction. Hereinafter, the direction in which the inwardly-extending portion 52 extends is referred to as a longitudinal direction X, and a direction orthogonal to both the longitudinal direction X and the plug axial direction Z is referred to as a lateral direction Y. As shown in FIGS. 2 and 4, a portion of the inwardly-extending portion 52 is placed in a position overlapping the tip surface 421 of the center electrode chip 42 in the plug axial direction Z. A surface of the inwardly-extending portion 52 on the base side is the aforementioned gap-forming surface 521.

As shown in FIG. 2, in the axial parallel cross-section, the virtual straight line L1 passing through the both ends of the insulator inclined surface 311 passes through the gap-forming surface 521 of the earth electrode 5. Specifically, in the axial parallel cross-section, the virtual straight line L1 passing through the both ends of the insulator inclined surface 311 passes through a region of the gap-forming surface 521 that is located on the side opposite to said insulator inclined surface 311 in the lateral direction Y.

Note that the earth electrode 5 is formed by, for example, bending an elongated sheet metal in the thickness direction thereof. Upon forming the earth electrode 5, such a sheet metal is bent at a right angle at one point in the longitudinal direction. Thus, portions on both sides of this bent portion serve as the upright portion 51 and the inwardly-extending portion 52.

As shown in FIG. 1, a resistor 13 is disposed in the shaft hole 30 of the insulator 3, on the base side of the center electrode 4 via an electrically conductive glass seal 12. The resistor 13 can be formed by sealing a resistor composition containing glass powders and a resistive material such as ceramic powder or carbon with heat or inserting a cartridge resistor. The glass seal 12 is made of copper glass produced by mixing glass with copper powder. Furthermore, a terminal metal fitting 14 is disposed on the base side of the resistor 13 via the glass seal 12 made of copper glass. The terminal metal fitting 14 is made of, for example, an iron alloy.

Next, with reference to FIG. 2, an ignition device in which the spark plug 1 according to the present embodiment is attached to the internal combustion engine is described.

At the attachment screw portion 21, the spark plug 1 is screwed into the female threaded hole 11 provided in the engine head 15. Thus, the spark plug 1 is securely fastened to the engine head 15. Furthermore, a tip portion of the spark plug 1 is positioned inside the combustion chamber 16. At this time, the spark plug 1 is oriented so that the airflow inside the combustion chamber moves in the lateral direction Y with respect to the tip portion.

Figure 5:
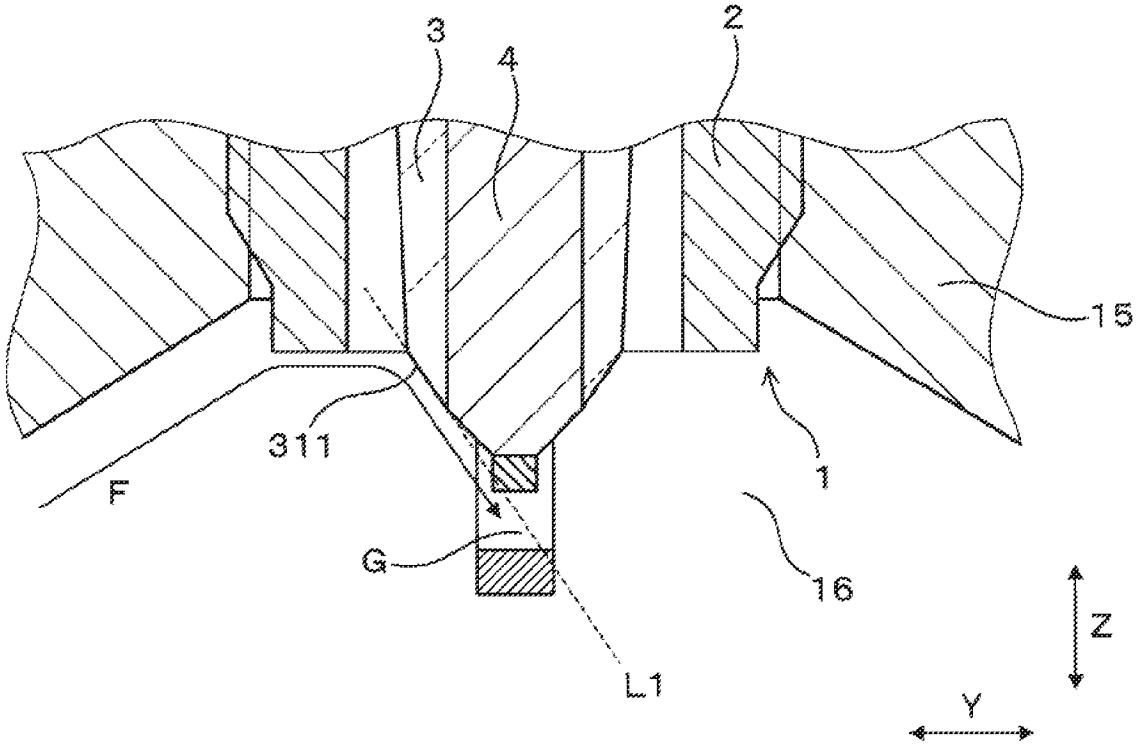
FIG. 5 is an explanatory cross-sectional view of the area around the tip portion of the spark plug according to Embodiment 1, for explaining movement of an airflow entering the spark plug.

Next, with reference to FIG. 5, movement of an airflow F of the air-fuel mixture around the discharge gap G is described.

In an area located upstream of the tip portion of the spark plug 1, the airflow F moves along a surface of the engine head 15. Specifically, in the area located upstream of the tip portion of the spark plug 1, the airflow F moves toward the tip portion of the spark plug 1 in substantially the lateral direction Y.

The airflow F moved in substantially the lateral direction Y with respect to the tip portion of the spark plug 1 changes a direction thereof along the insulator inclined surface 311 of the insulator 3 to a diagonal direction toward the tip and travels toward the gap-forming surface 521 of the earth electrode 5 on an extension of the insulator inclined surface 311. Subsequently, the airflow F runs through the discharge gap G diagonally toward the tip. In this manner, the insulator inclined surface 311 of the insulator 3 that is located close to the discharge gap G changes the direction of the airflow F. Therefore, the airflow F flows in the discharge gap G at an angle close to the plug axial direction Z.

Next, the effects produced in the present embodiment are described.

In the spark plug 1 for internal combustion engines according to the present embodiment, the insulator protrusion 31 of the insulator 3 protrudes on the tip side of the housing 2. Thus, carbon is less likely to accumulate on a surface of the insulator protrusion 31 of the insulator 3. Accordingly, the occurrence of lateral sparks can be reduced.

Figure 6:
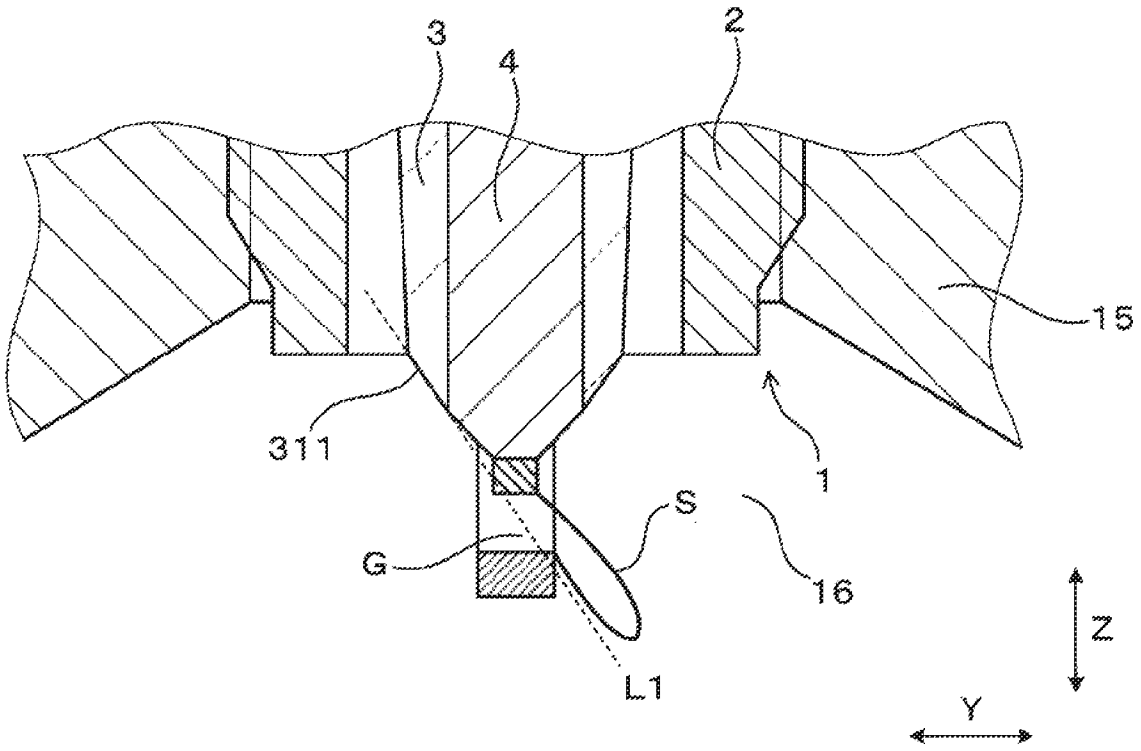
FIG. 6 is an explanatory cross-sectional view of the area around the tip portion of the spark plug according to Embodiment 1, for explaining a situation in which an electric spark is stretched.

Furthermore, the outer peripheral surface of the insulator protrusion 31 includes the insulator inclined surface 311 extending inward toward the tip in the plug axial direction Z, in a straight line or a curve that is convex inward, in the axial parallel cross-section. Moreover, in the axial parallel cross-section, the virtual straight line L1 passing through the both ends of the insulator inclined surface 311 passes through the gap-forming surface 521 of the earth electrode 5. Thus, as shown in FIG. 5, the airflow F in the combustion chamber 16 is guided to move along the insulator inclined surface 311 and run through the discharge gap G. This allows the airflow F to moderately move through the discharge gap G. Therefore, as shown in FIG. 6, the electric spark S can be easily stretched, and the ignitability of the air-fuel mixture in the combustion chamber 16 can be easily increased.

Furthermore, as shown in FIG. 5, the airflow F in the combustion chamber 16 is guided by the insulator inclined surface 311 so as to flow in the discharge gap G diagonally toward the tip. Therefore, as shown in FIG. 6, the electric spark S is stretched by the airflow diagonally toward the tip, in other words, toward the center of the combustion chamber 16. To put it differently, the electric spark S is stretched away from the engine head 15. Thus, the heat of a flame caused by the electric spark S igniting the air-fuel mixture can be easily prevented from being drawn by the engine head 15, meaning that the flame is likely to grow.

Furthermore, as shown in FIG. 5, in the spark plug 1 for internal combustion engines according to the present embodiment, the insulator inclined surface 311 of the insulator 3 that is located closer to the discharge gap G than the housing 2 is guides the direction of travel of the airflow F. Therefore, the airflow F can enter the discharge gap G at an angle close to the plug axial direction Z. Thus, as shown in FIG. 6, the electric spark S can be more easily stretched toward the tip, and the ignitability can be more easily increased.

Furthermore, the outer peripheral surface of the insulator protrusion 31 includes, along the entire perimeter thereof, the insulator inclined surface 311. Thus, no matter which way in the lateral direction Y the airflow F moves to the tip portion of the spark plug 1, the insulator inclined surface 311 can guide the airflow F to the discharge gap G. Moreover, the shape of the insulator protrusion 31 can easily be made simple.

As described above, according to the present embodiment, it is possible to provide a spark plug for internal combustion engines that easily increases the ignitability of an air-fuel mixture in a combustion chamber with less likelihood of lateral sparks.

Embodiment 2

Figure 7:
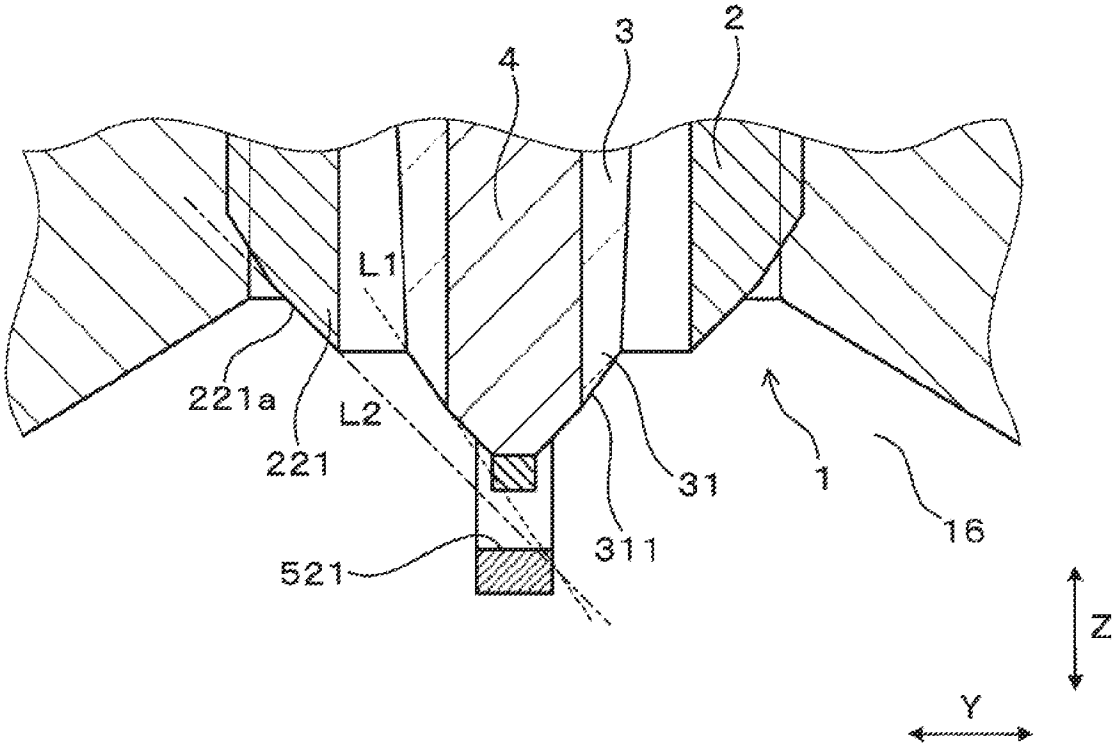
FIG. 7 is a cross-sectional view of an area around a tip portion of a spark plug according to Embodiment 2 attached to an internal combustion engine.
Figure 8:
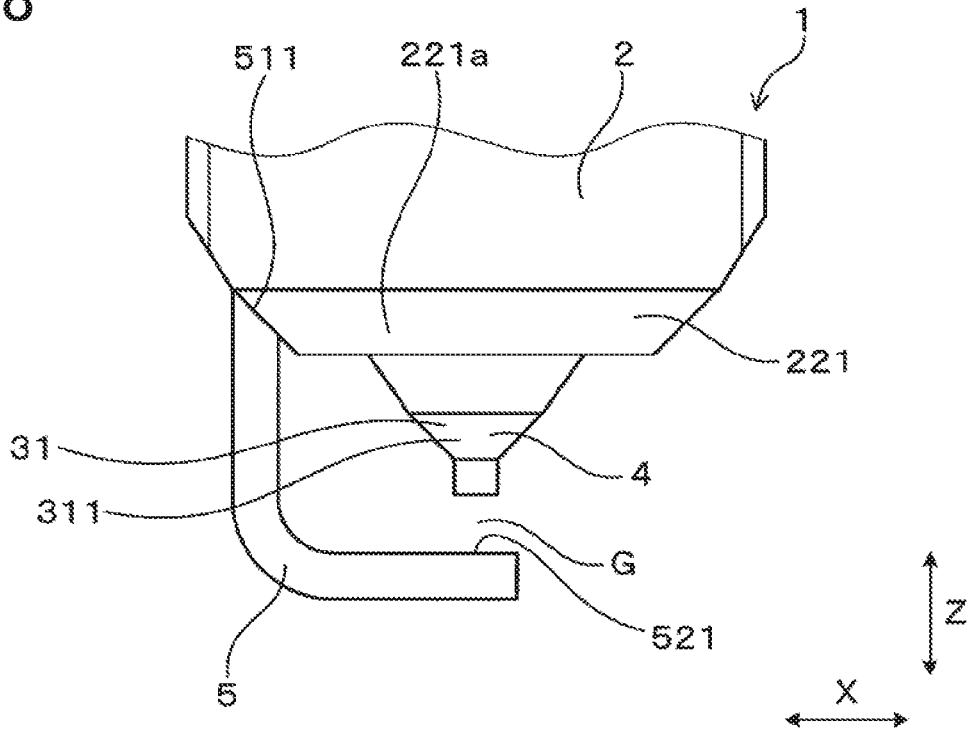
FIG. 8 is a side view of the area around the tip portion of the spark plug according to Embodiment 2.

The present embodiment is different from Embodiment 1 in that the housing 2 has a different shape, as shown in FIGS. 7 and 8.

Similar to Embodiment 1, the housing 2 includes the housing exposed portion 221 which is exposed to the combustion chamber 16, as shown in FIG. 7. As shown in FIGS. 7 and 8, in the present embodiment, the outer peripheral surface of the housing exposed portion 221 includes a housing inclined surface 221*a* inclined inward toward the tip in the plug axial direction Z. As shown in FIG. 7, in the axial parallel cross-section, a housing-side virtual straight line L2 passing through both ends of the housing inclined surface 221*a* passes through the gap-forming surface 521.

As shown in FIG. 7, the housing inclined surface 221*a* is formed in a straight line to extend inward toward the tip in the axial parallel cross-section. The outer peripheral surface of the housing exposed portion 221 includes the housing inclined surface 221*a* in an axial parallel cross-section orthogonal to at least both the plug axial direction Z and the lateral direction Y. In the present embodiment, the outer peripheral surface of the housing exposed portion 221 includes, along the entire perimeter thereof, the housing inclined surface 221*a*. In other words, the outer peripheral surface of the housing exposed portion 221 includes the housing inclined surface 221*a* in every cross-section passing through the plug center axis and parallel to the plug axial direction Z.

The size of the housing inclined surface 221*a* is formed to be larger in the plug axial direction Z than in the plug radial direction in the axial parallel cross-section. In the present embodiment, the housing inclined surface 221*a* is formed to connect to the inner peripheral surface of the housing 2.

As shown in FIG. 7, in the axial parallel cross-section, the housing-side virtual straight line L2 passing through the both ends of the housing inclined surface 221*a* passes through the gap-forming surface 521 of the earth electrode 5. Specifically, in the axial parallel cross-section, the housing-side virtual straight line L2 passes through a region of the gap-forming surface 521 that is located on the side opposite to said housing inclined surface 221*a* in the lateral direction Y.

As shown in FIG. 8, the earth electrode 5 is joined to the housing inclined surface 221*a*. The earth-connecting portion 511 of the earth electrode 5 is formed parallel to the housing inclined surface 221*a*.

The other details are the same as or similar to those in Embodiment 1.

Note that among reference signs used in Embodiment 2 and subsequent embodiments, reference signs that are the same as those used in the previously described embodiment represent structural elements that are the same as or similar to those in the previously described embodiment unless otherwise noted.

In the present embodiment, in addition to the insulator inclined surface 311 of the insulator protrusion 31, the housing inclined surface 221*a* of the housing 2 can be used to guide the airflow to the discharge gap G. Thus, the electric spark can be more easily stretched.

Aside from this, substantially the same effects as those in Embodiment 1 are produced.

Embodiment 3

The present embodiment is different from Embodiment 2 in that the earth electrode 5 has a different shape, as shown in FIGS. 9 to 14.

Figure 9:
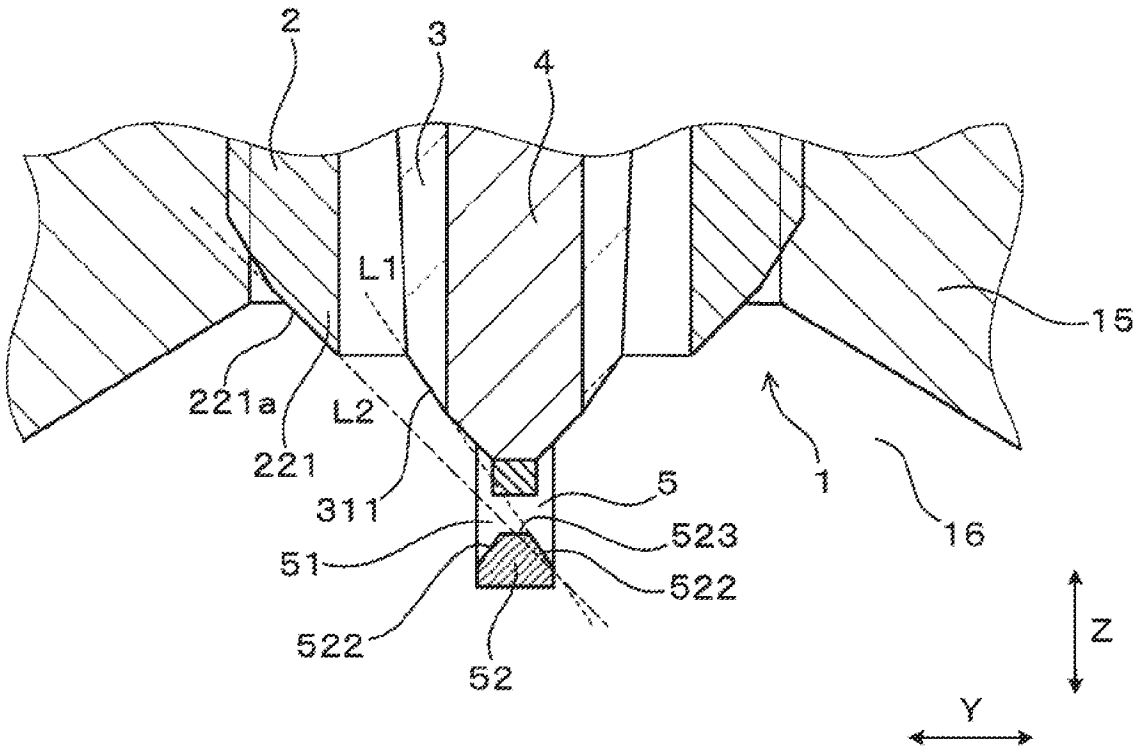
FIG. 9 is a cross-sectional view of an area around a tip portion of a spark plug according to Embodiment 3 attached to an internal combustion engine.
Figure 10:
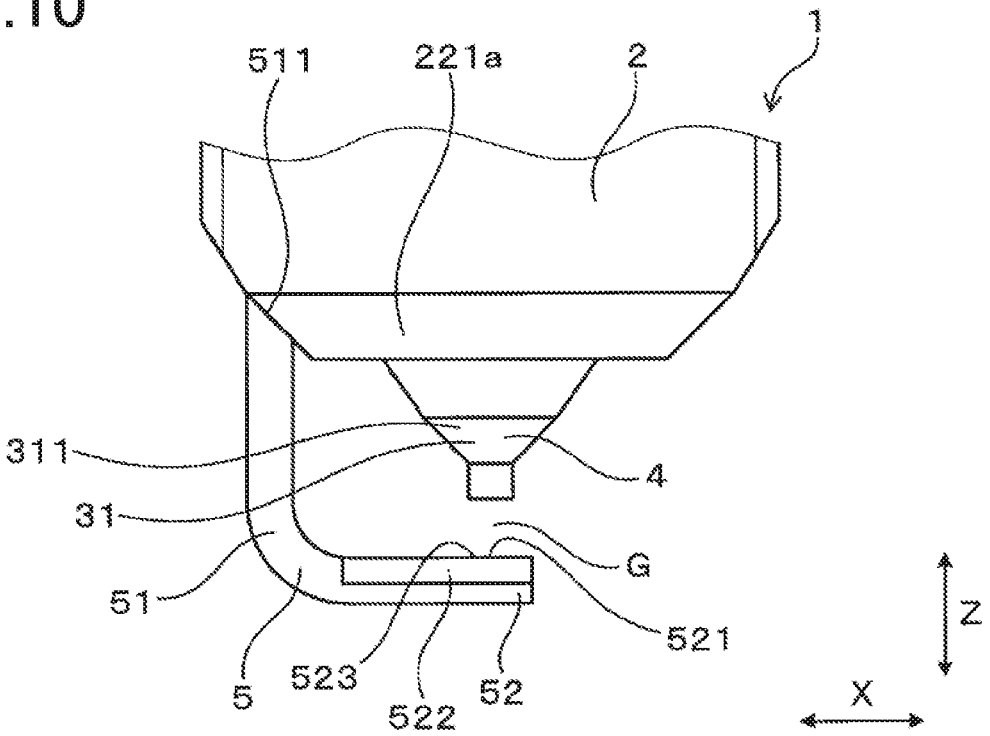
FIG. 10 is a side view of the area around the tip portion of the spark plug according to Embodiment 3.

As shown in FIG. 9, the gap-forming surface 521 which is a base-side surface of the inwardly-extending portion 52 includes: a flat surface 523 orthogonal to the plug axial direction Z; and a pair of earth inclined surfaces 522 formed on both sides of the flat surface 523 in the lateral direction Y. The earth inclined surfaces 522 are oriented in a direction opposite to the insulator inclined surface 311. In the present embodiment, in an axial parallel cross-section parallel to both the plug axial direction Z and the lateral direction Y, the earth inclined surfaces 522 are located on the virtual straight line L1. The earth inclined surfaces 522 are parallel to the insulator inclined surface 311 in the axial parallel cross-section. As shown in FIG. 10, the earth inclined surfaces 522 are formed on substantially the entirety of the inwardly-extending portion 52 in the longitudinal direction X.

Figure 11:
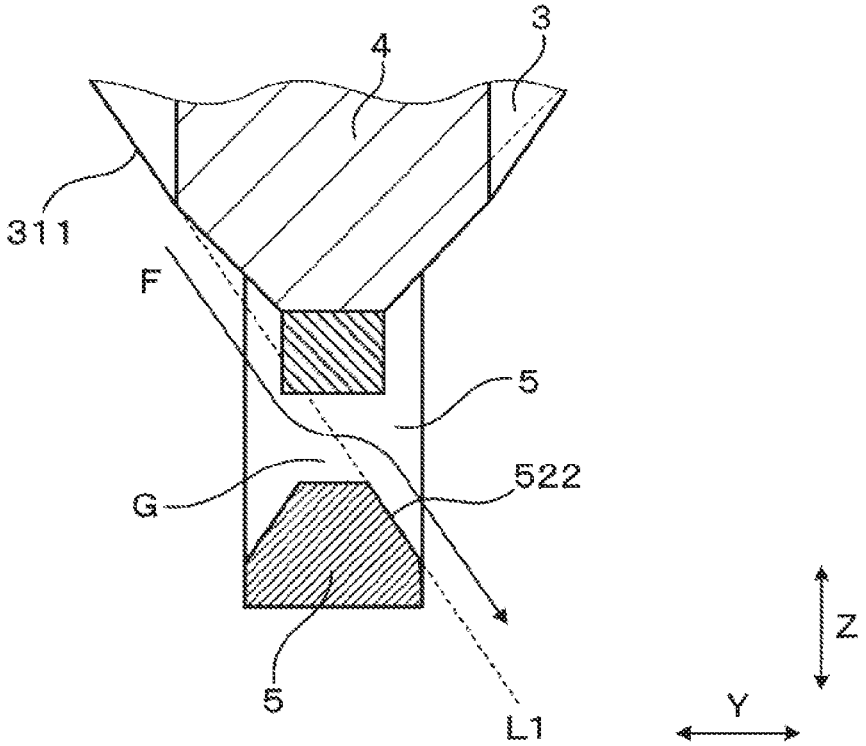
FIG. 11 is an explanatory cross-sectional view of the area around the tip portion of the spark plug according to Embodiment 3, for explaining movement of an airflow around a discharge gap.

Next, with reference to FIG. 11, movement of the airflow F having passed through the discharge gap G in the present embodiment is described.

In the present embodiment, the airflow F having passed through the discharge gap G moves along an earth inclined surface 522. Thus, the airflow F having passed through the discharge gap G moves parallel to the earth inclined surface 522, in other words, diagonally toward the tip.

Figure 12:
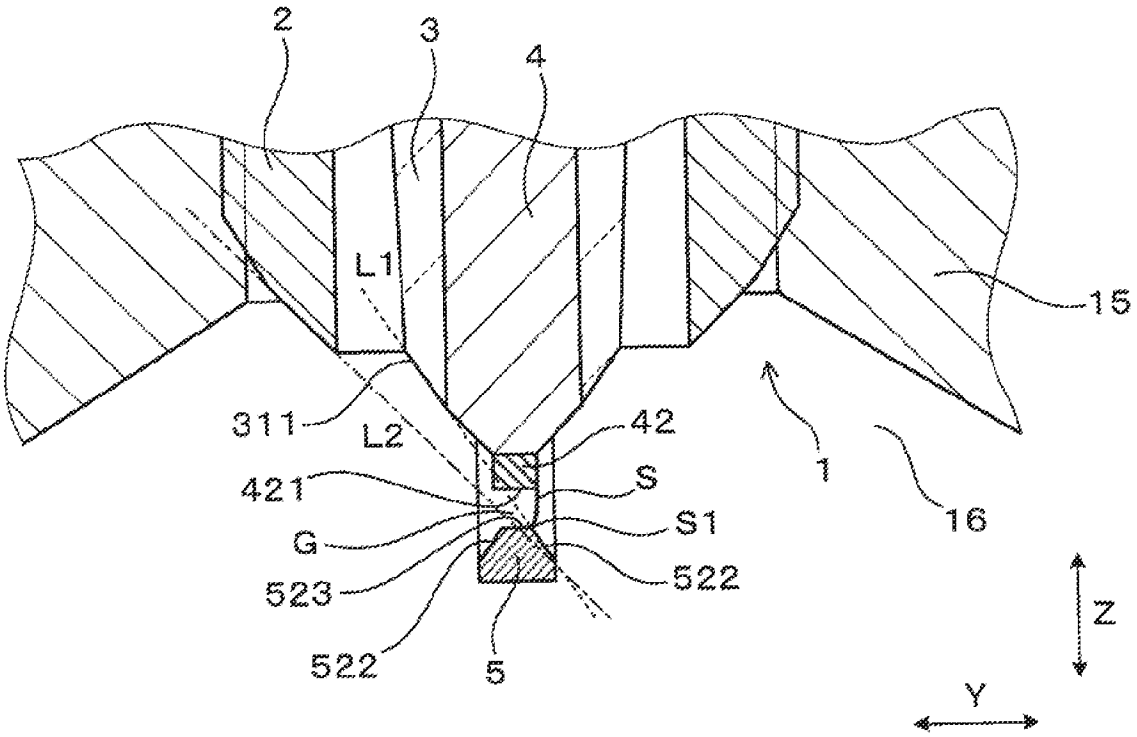
FIG. 12 is an explanatory cross-sectional view of the area around the tip portion of the spark plug according to Embodiment 3 that shows an initial electric spark.
Figure 13:
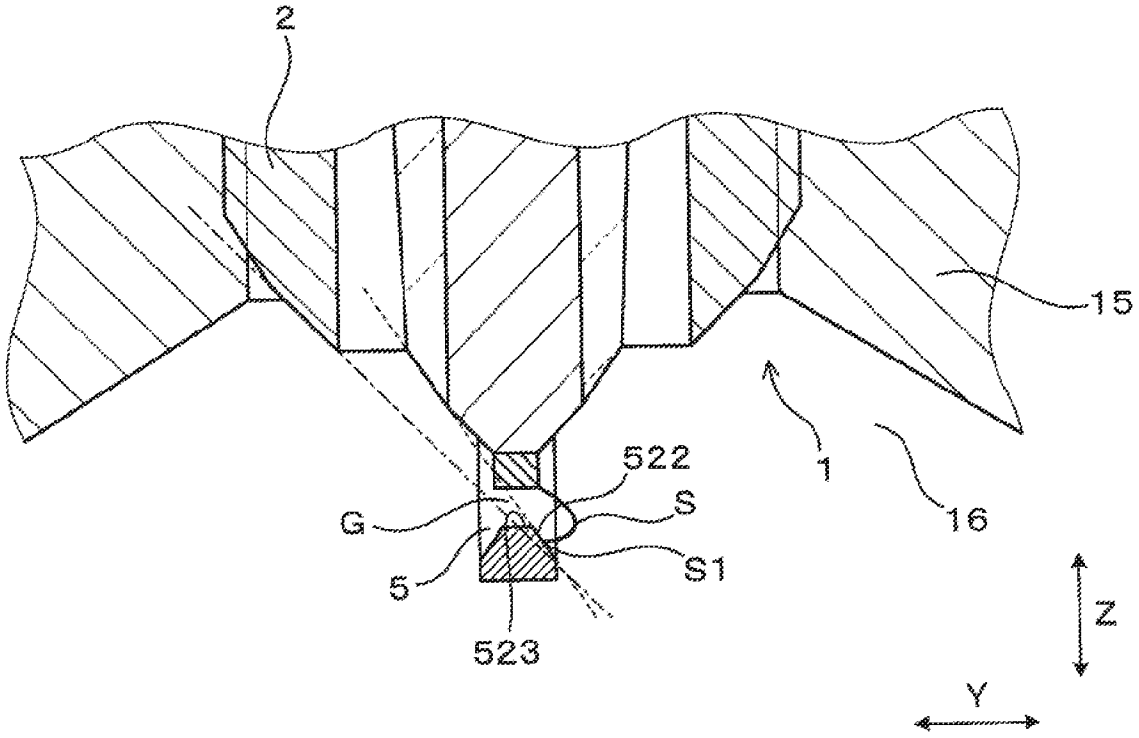
FIG. 13 is an explanatory cross-sectional view of the area around the tip portion of the spark plug according to Embodiment 3 that shows a situation in which an earth-side starting point of the electric spark moves on an earth inclined surface.
Figure 14:
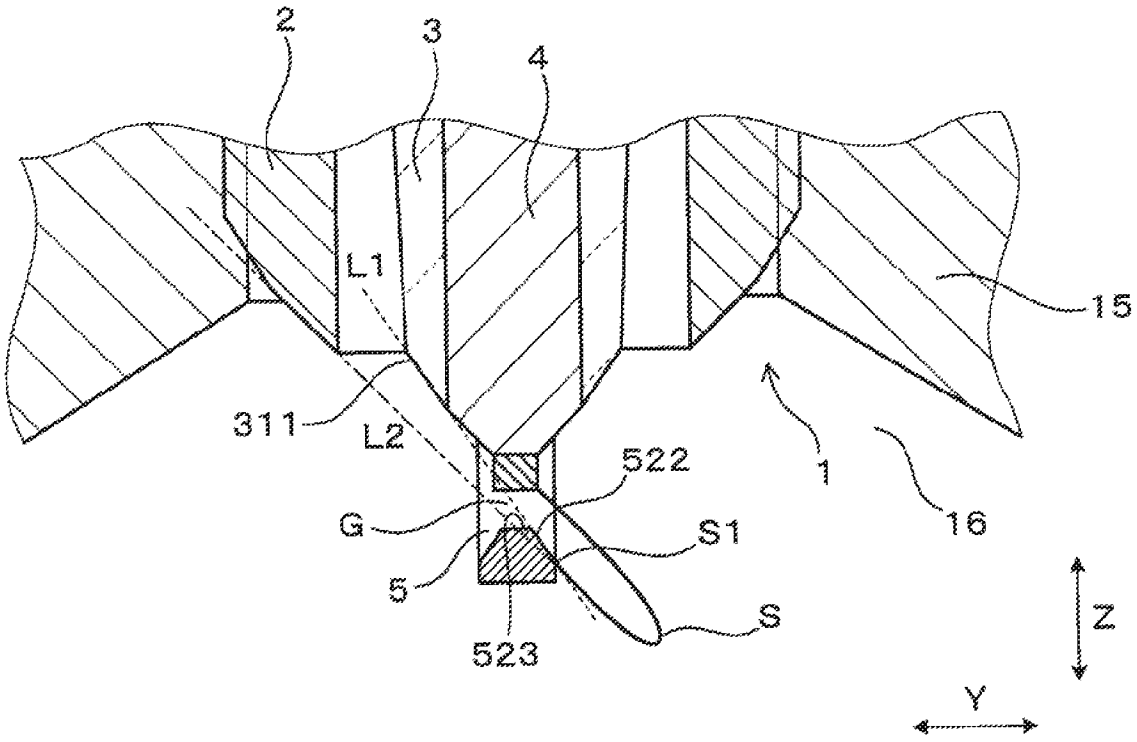
FIG. 14 is an explanatory cross-sectional view of the area around the tip portion of the spark plug according to Embodiment 3 that shows a situation in which the earth-side starting point of the electric spark moves to a tip portion of the earth inclined surface.

Next, with reference to FIGS. 12 to 14, stretching of the electric spark S by the airflow of the air-fuel mixture in the present embodiment is described.

First, as shown in FIG. 12, spark discharge occurs in the discharge gap G as a result of application of a predetermined voltage between the center electrode 4 and the earth electrode 5. The initial electric spark S is likely to occur at an edge of the flat surface 523 included in the gap-forming surface 521 of the earth electrode 5. This is because the flat surface 523 is close in distance to the tip surface 421 of the center electrode chip 42 and surrounding electric fields tend to concentrate on the edge of the flat surface 523.

The initial electric spark S is stretched toward the downstream end by the airflow of the air-fuel mixture, as shown in FIGS. 13 and 14. As mentioned earlier, the airflow of the air-fuel mixture having passed through the discharge gap G moves along the earth inclined surface 522 diagonally toward the tip. Therefore, the electric spark S is stretched not only in the lateral direction Y, but also toward the tip.

Furthermore, while the electric spark S is stretched toward the downstream end, the starting point of the electric spark S on the earth electrode 5 side (hereinafter referred to as an earth-side starting point S1) is pushed by the airflow and creeps from the edge of the flat surface 523 diagonally toward the tip along the earth inclined surface 522. As the earth-side starting point S1 moves, the direct distance between both starting points of the electric spark S increases, and a portion between the both starting points is significantly stretched toward the downstream end, in other words, diagonally toward the tip. The air-fuel mixture is ignited by the electric spark S while being stretched.

The other details are the same as or similar to those in Embodiment 2.

In the present embodiment, the earth electrode 5 has the earth inclined surface 522 which is oriented in a direction opposite to the insulator inclined surface 311. Therefore, the airflow F having passed through the discharge gap G is guided by the earth inclined surface 522 to move diagonally toward the tip. Thus, the electric spark S can be more easily stretched toward the tip.

Furthermore, in the present embodiment, as mentioned earlier, the earth-side starting point S1 of the electric spark S moves, and the direct distance between the both starting points of the electric spark S increases. Thus, as a result of an increase in the direct distance between the both starting points of the electric spark S, a short circuit between a portion of the stretched electric spark S and another portion is easily prevented, and the electric spark S is easily significantly stretched.

The insulator inclined surface 311 is formed in a straight line in the axial parallel cross-section, and the earth inclined surface 522 is parallel to the insulator inclined surface 311 in the axial parallel cross-section. Therefore, with both the insulator inclined surface 311 and the earth inclined surface 522, the airflow F running through the discharge gap G diagonally toward the tip can easily be made smooth.

Aside from this, substantially the same effects as those in Embodiment 2 are produced.

Embodiment 4

Figure 15:
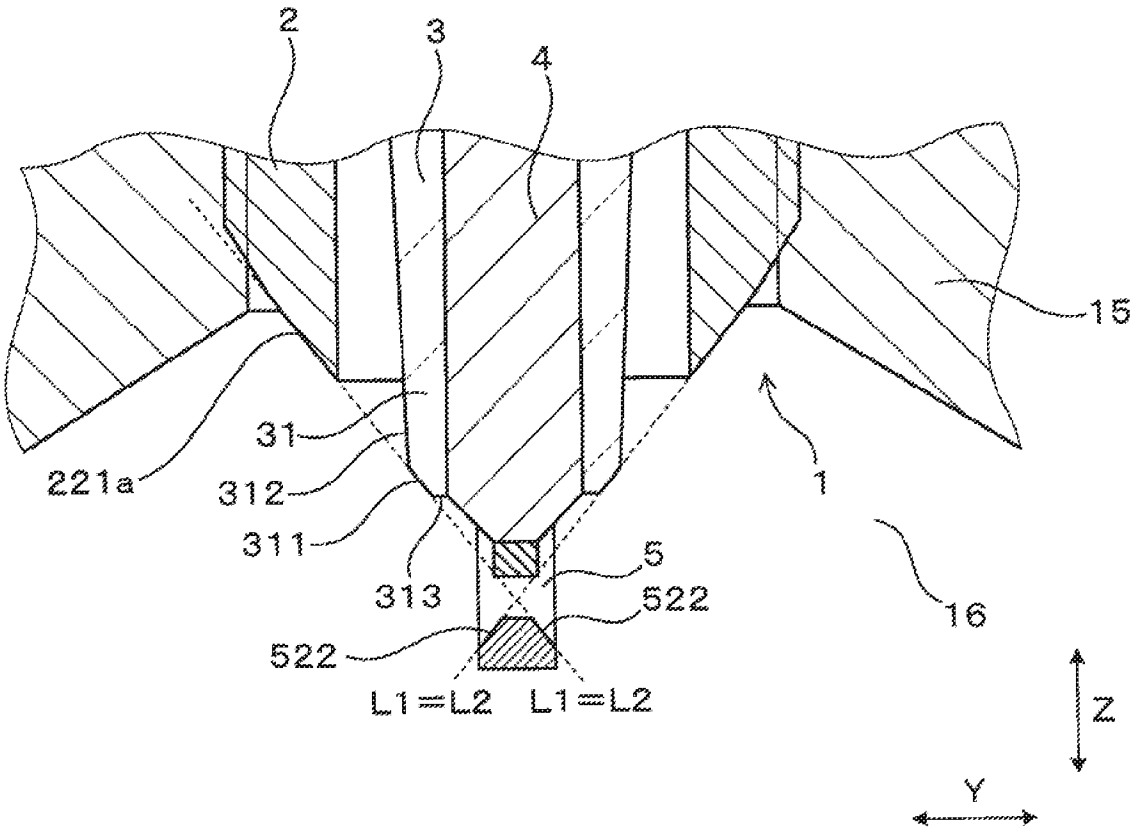
FIG. 15 is a cross-sectional view of an area around a tip portion of a spark plug according to Embodiment 4 attached to an internal combustion engine.

In the present embodiment, as shown in FIG. 15, in an axial parallel cross-section parallel to both the plug axial direction Z and the lateral direction Y, the housing inclined surface 221*a*, the insulator inclined surface 311, and the earth inclined surface 522 are arranged on the same straight line.

A surface of the insulator protrusion 31 includes an insulator protrusion side surface 312 to be described later, the insulator inclined surface 311, and an insulator tip surface 313 to be described later. The insulator protrusion side surface 312 is slightly inclined inward toward the tip. In the axial parallel cross-section, the straight line passing through the both ends of the insulator protrusion side surface 312 does not pass through the gap-forming surface 521 of the earth electrode 5.

The insulator inclined surface 311, which is inclined more than the insulator protrusion side surface 312 is, is formed from the tip of the insulator protrusion side surface 312. As mentioned earlier, the virtual straight line L1 passing through the both ends of the insulator inclined surface 311 passes through the gap-forming surface 521 of the earth electrode 5. The insulator tip surface 313 is formed parallel to the plug axial direction Z, inward from the tip of the insulator inclined surface 311.

In the present embodiment, in the axial parallel cross-section, the virtual straight line L1 passing through the both ends of the insulator inclined surface 311 and the housing-side virtual straight line L2 are the same straight line.

The other details are the same as or similar to those in Embodiment 3.

In the present embodiment, in the axial parallel cross-section parallel to the plug axial direction Z and the lateral direction Y, the housing inclined surface 221*a*, the insulator inclined surface 311, and the earth inclined surface 522 are arranged on the same straight line, and thus the airflow F is more easily directed to the discharge gap G.

Aside from this, substantially the same effects as those in Embodiment 3 are produced.

Embodiment 5

Figure 16:
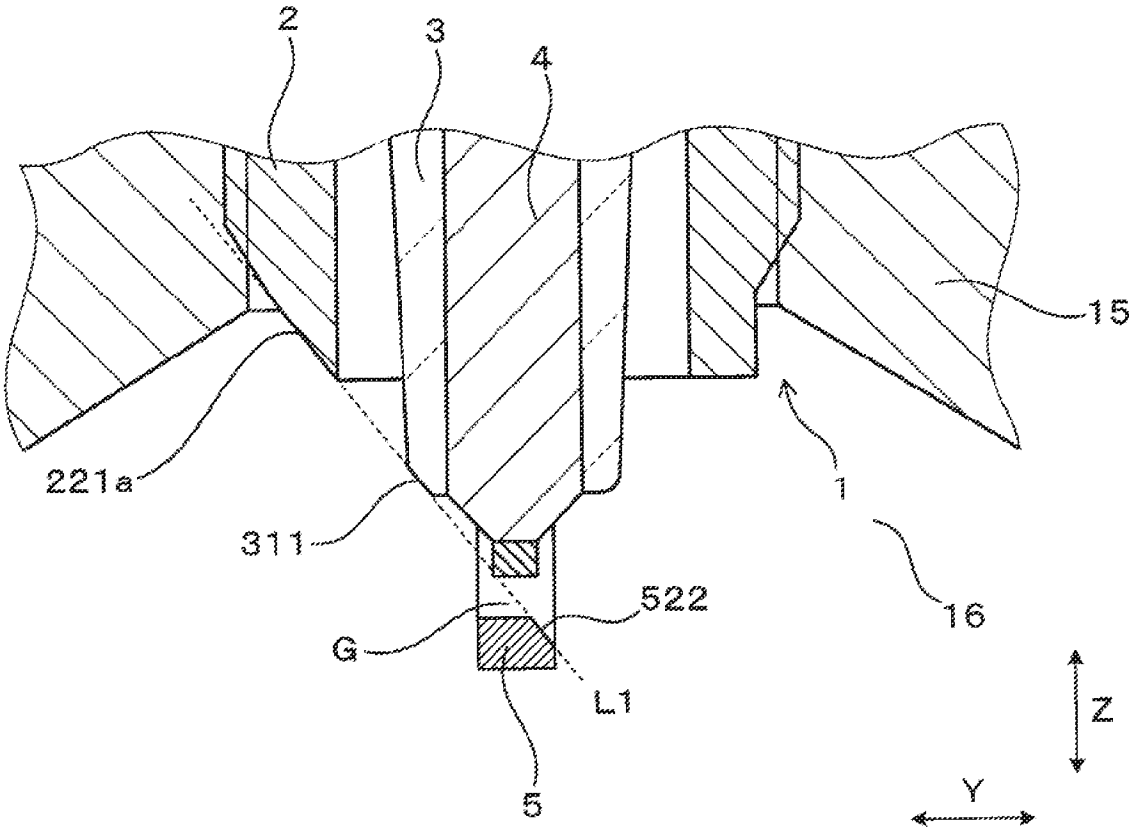
FIG. 16 is a cross-sectional view of an area around a tip portion of a spark plug according to Embodiment 5 attached to an internal combustion engine.
Figure 17:
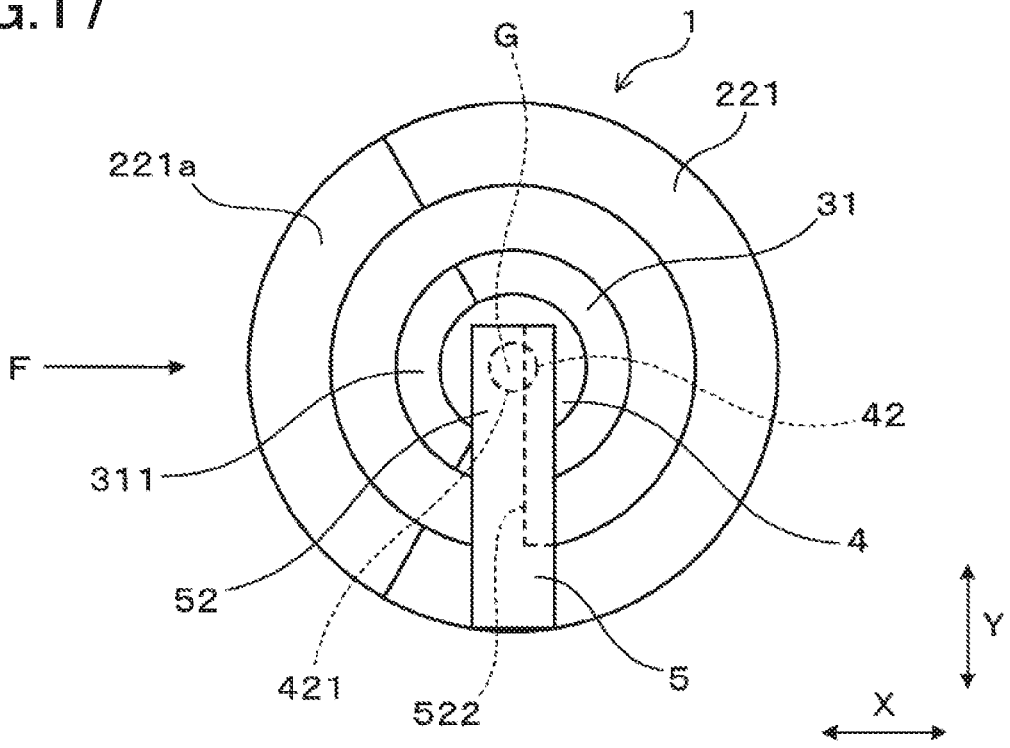
FIG. 17 is a plan view of a portion of the spark plug according to Embodiment 5 that is exposed in the internal combustion engine when viewed from the tip side.

The present embodiment is different from Embodiment 4 in that the insulator inclined surface 311, the housing inclined surface 221*a*, and the earth inclined surface 522 are formed at different positions, as shown in FIGS. 16 and 17.

The insulator inclined surface 311 and the housing inclined surface 221*a* are formed only in an area located upstream in the airflow F of the discharge gap G in the lateral direction Y. As shown in FIG. 17, the insulator inclined surface 311 is formed in the range of approximately 120 degrees of the insulator protrusion 31. Similarly, the housing inclined surface 221*a* is formed in the range of approximately 120 degrees of the housing exposed portion 221. The insulator inclined surface 311 and the housing inclined surface 221*a* are formed at positions that overlap with each other in the plug radial direction. The earth inclined surface 522 is formed only in an area located downstream in the airflow F of the discharge gap G in the lateral direction Y.

The other details are the same as or similar to those in Embodiment 4.

Also in the present embodiment, substantially the same effects as those in Embodiment 4 are produced.

Embodiment 6

Figure 18:
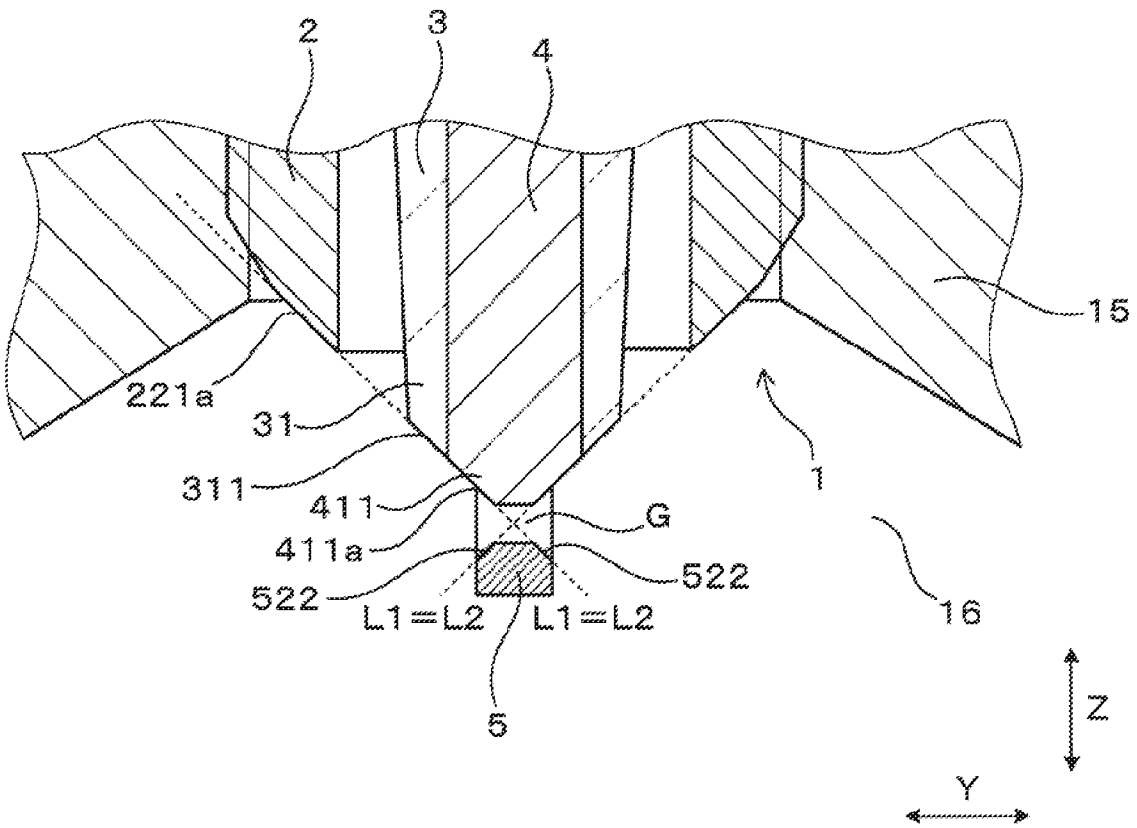
FIG. 18 is a cross-sectional view of an area around a tip portion of a spark plug according to Embodiment 6 attached to an internal combustion engine.

The present embodiment is different from Embodiment 4 in that the center electrode 4 has a different shape, as shown in FIG. 18.

In the present embodiment, the center electrode 4 does not include the center electrode chip (refer to reference sign 42 in Embodiments 1 to 5). An outer peripheral surface 411*a* of the center electrode protrusion 411, which protrudes further on the tip side than the insulator protrusion 31 does, of the center electrode 4 is formed in a straight line inclined inward toward the tip in the axial parallel cross-section. In the axial parallel cross-section orthogonal to both the plug axial direction Z and the lateral direction Y, the housing inclined surface 221*a*, the insulator inclined surface 311, the outer peripheral surface 411*a* of the center electrode protrusion 411, and the earth inclined surface 522 are arranged on the same straight line. Note that the shape of the insulator inclined surface 311 is substantially the same as that in Embodiment 3.

The other details are the same as or similar to those in Embodiment 4.

In the present embodiment, in the axial parallel cross-section parallel to the plug axial direction Z and the lateral direction Y, the housing inclined surface 221*a*, the insulator inclined surface 311, the outer peripheral surface 411*a* of the center electrode protrusion 411, and the earth inclined surface 522 are arranged on the same straight line, and thus the airflow is more easily directed to the discharge gap G.

Aside from this, substantially the same effects as those in Embodiment 4 are produced.

Figure 19:
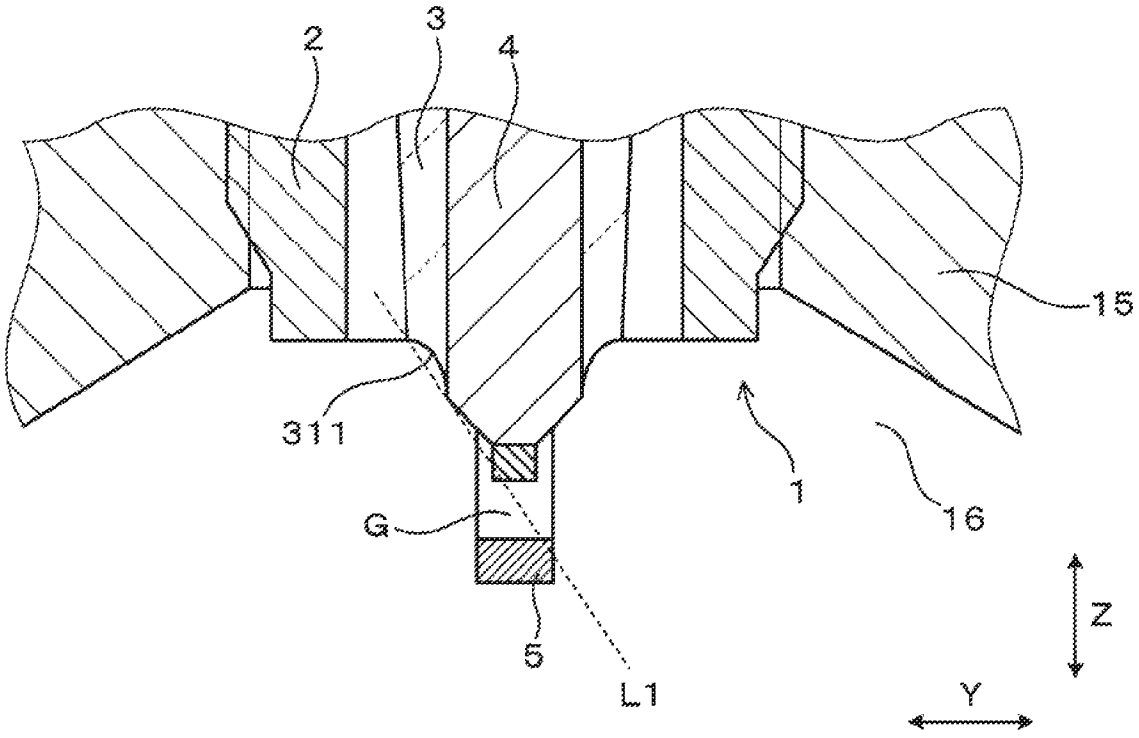
FIG. 19 is a cross-sectional view of an area around a tip portion of a spark plug according to a variation attached to an internal combustion engine.
Figure 20:
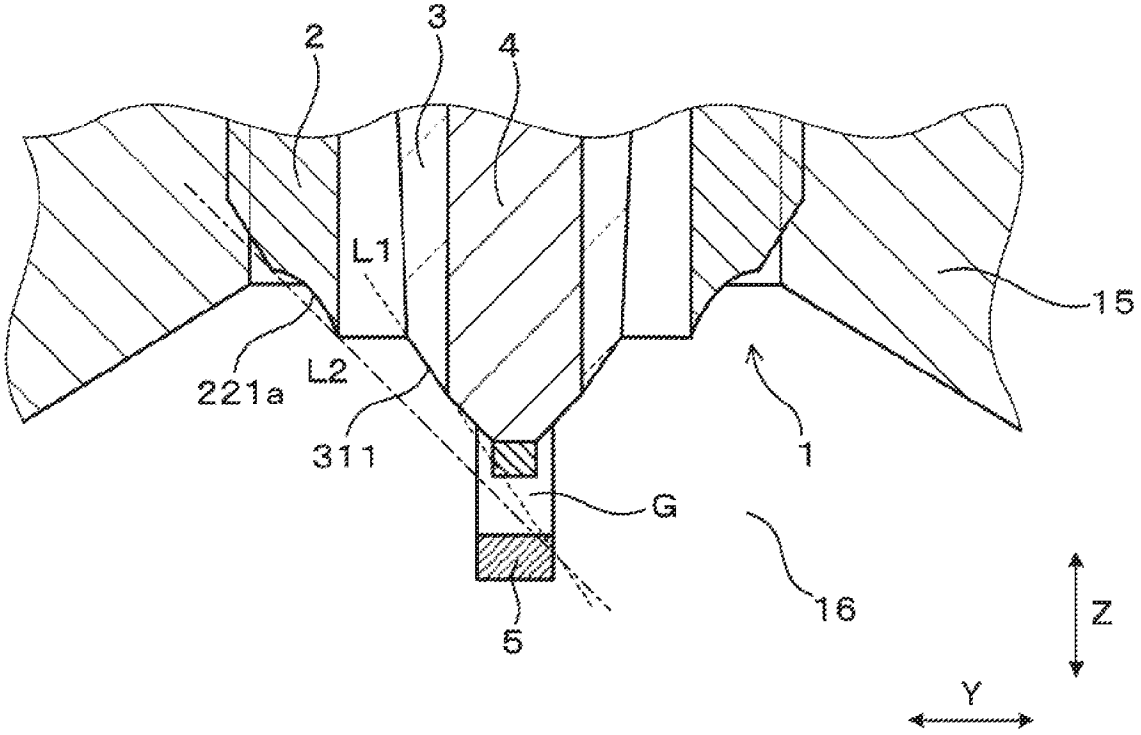
FIG. 20 is a cross-sectional view of an area around a tip portion of a spark plug according to another variation attached to an internal combustion engine.

The present disclosure has been described in accordance with the embodiments, but the present disclosure should in no way be construed as being limited to the embodiments, the configuration, etc. The present disclosure encompasses various variations and modifications made within the range of equivalence. In addition, various combinations and forms, and furthermore, other combinations and forms including only one element of these and elements no less than or no more than these are also included in the scope or concept range of the present disclosure. For example, as shown in FIG. 19, the insulator inclined surface 311 can be formed in a curve that is convex inward in the axial parallel cross-section. Similarly, as shown in FIG. 20, the housing inclined surface 221*a* can be formed in a curve that is convex inward.

What is claimed is:

1. A spark plug for internal combustion engines, comprising:

a housing having a cylindrical shape;

an insulator held inside the housing and having a cylindrical shape;

a center electrode held inside the insulator; and an earth electrode having a gap-forming surface a portion of which forms a discharge gap between said portion and the tip surface of the center electrode, wherein the insulator includes an insulator protrusion protruding on a tip side of the housing, an outer peripheral surface of the insulator protrusion includes an insulator inclined surface extending inward toward a tip in a plug axial direction, in a straight line or a curve that is convex inward, in an axial parallel cross-section that is at least one of cross-sections passing through a plug center axis and parallel to the plug axial direction, in the axial parallel cross-section, a virtual straight line passing through both ends of the insulator inclined surface passes through the gap-forming surface, the housing includes a housing exposed portion which is exposed to a combustion chamber, an outer peripheral surface of the housing exposed portion includes a housing inclined surface inclined inward toward the tip in the plug axial direction, and in the axial parallel cross-section, a housing-side virtual straight line passing through both ends of the housing inclined surface passes through the gap-forming surface, with the proviso that a spark plug comprising a center electrode covered with a conductor cylinder inside an insulator is excluded.

2. The spark plug for internal combustion engines according to claim 1, wherein the earth electrode has an earth inclined surface oriented in a direction opposite to the insulator inclined surface.

3. The spark plug for internal combustion engines according to claim 2, wherein the insulator inclined surface is formed in a straight line in the axial parallel cross-section, and the earth inclined surface is parallel to the insulator inclined surface in the axial parallel cross-section.

4. The spark plug for internal combustion engines according to claim 1, wherein the outer peripheral surface of the insulator protrusion includes the insulator inclined surface along an entire perimeter of the outer peripheral surface.

* * * * *